US010687580B2

(12) United States Patent
Park

(10) Patent No.: US 10,687,580 B2
(45) Date of Patent: Jun. 23, 2020

(54) FUNCTIONAL SHOES AND FUNCTIONAL UNIT FOR SHOES

(71) Applicant: Hong-Soon Park, Gyeonggi-do (KR)

(72) Inventor: Hong-Soon Park, Gyeonggi-do (KR)

( * ) Notice: Subject to any disclaimer, the term of this patent is extended or adjusted under 35 U.S.C. 154(b) by 1 day.

(21) Appl. No.: 16/121,166

(22) Filed: Sep. 4, 2018

(65) Prior Publication Data

US 2019/0075883 A1 Mar. 14, 2019

(30) Foreign Application Priority Data

Sep. 13, 2017 (KR) ..... 10-2017-0117283

(51) Int. Cl.

| | |
|---|---|
| ***A43C 15/02*** | (2006.01) |
| ***A43B 3/24*** | (2006.01) |
| ***A43B 5/16*** | (2006.01) |
| ***A63C 17/00*** | (2006.01) |
| ***A43C 15/18*** | (2006.01) |
| ***A43B 13/14*** | (2006.01) |
| ***A43B 13/26*** | (2006.01) |
| ***A63C 17/20*** | (2006.01) |
| ***A63C 17/04*** | (2006.01) |
| ***A43C 15/00*** | (2006.01) |
| ***A63C 17/18*** | (2006.01) |

(52) U.S. Cl.

CPC ..... *A43B 3/246* (2013.01); *A43B 5/16* (2013.01); *A43B 5/1633* (2013.01); *A43B 5/1641* (2013.01); *A43B 13/14* (2013.01); *A43B 13/26* (2013.01); *A43C 15/00* (2013.01); *A43C 15/02* (2013.01); *A43C 15/18* (2013.01); *A63C 17/008* (2013.01); *A63C 17/04* (2013.01); *A63C 17/18* (2013.01); *A63C 17/20* (2013.01); *A63C 2203/06* (2013.01)

(58) Field of Classification Search

CPC ..... A43C 15/08; A43C 15/14; A43C 15/02; A43C 15/18; A43B 5/16; A43B 5/1641; A63C 17/18; A63C 2203/06

USPC ..... 36/101, 15, 61, 62, 64, 66

See application file for complete search history.

(56) References Cited

U.S. PATENT DOCUMENTS 997,055 A * 7/1911 Gilowitz ..... A43C 15/08 36/61
1,435,765 A * 11/1922 Tulkan ..... A43C 15/08 36/61

(Continued)

FOREIGN PATENT DOCUMENTS

| | | |
|---|---|---|
| KR | 2004-72874 Y1 | 6/2014 |
| KR | 10-1544159 B1 | 8/2015 |
| KR | 10-1577048 B1 | 12/2015 |

*Primary Examiner* — Ted Kavanaugh
(74) *Attorney, Agent, or Firm* — Merchant & Gould P.C.

(57) ABSTRACT

Functional shoes include a sole, a coupling member including a coupling body detachably coupled to the sole; an auxiliary lever coupled to the coupling body so as to be rotatable toward a bottom surface of the sole; and a fixing part protruding from the auxiliary lever toward the bottom surface of the sole and is detachably coupled to the sole, and at least one functional member provided integrally with the coupling body or detachably coupled to the coupling body to provide a predetermined function to the shoes. The fixing part moves between a coupling position in which the fixing part is coupled to the sole and a separation position in which the fixing part is separated from the sole, by a rotation of the auxiliary lever.

6 Claims, 9 Drawing Sheets

(56) References Cited

U.S. PATENT DOCUMENTS

| | | | | |
|---|---|---|---|---|
| 2,022,655 | A | 12/1935 | Driscoll | |
| 2,776,499 | A * | 1/1957 | Giuntini | A43C 15/08 36/135 |
| 4,875,300 | A * | 10/1989 | Kazz | A43B 13/26 36/134 |
| 2007/0163148 | A1* | 7/2007 | Laporte | A43C 15/08 36/61 |
| 2011/0113653 | A1* | 5/2011 | Grimmeisen | A43B 3/246 36/134 |
| 2013/0145651 | A1* | 6/2013 | Bathum | A43B 13/38 36/43 |

* cited by examiner

FUNCTIONAL SHOES AND FUNCTIONAL UNIT FOR SHOES

CROSS-REFERENCE TO RELATED APPLICATION

This application is claims the benefit of priority to Korean Patent Application No. 10-2017-0117283, filed in the Korean Intellectual Property Office on Sep. 13, 2017, the entire contents of which are incorporated herein by reference.

TECHNICAL FIELD

The present disclosure relates to functional shoes, and a functional unit for shoes that is applied to soles of the shoes to provide a predetermined function to the shoes.

BACKGROUND

Shoes were originally intended to protect feet from external impact or foreign matter. However, users often add special functions to shoes. Alternatively, in many cases, shoes have special functions from the manufacturing stage. For example, climbers attach climbing irons to shoes to prevent slipping, and wheeled shoes were once widely prevalent.

However, apparatuses, such as climbing irons, for providing special functions to shoes have problems in that the apparatuses are not easy to attach or are not robust even though attached. Furthermore, shoes having a predetermined function from the manufacturing stage are inefficient in that it is difficult to provide a different function, other than the function, to the shoes.

SUMMARY

The present disclosure has been made to solve the above-mentioned problems occurring in the prior art while advantages achieved by the prior art are maintained intact.

An aspect of the present disclosure provides functional shoes and a functional unit for shoes, for selectively providing various functions.

Another aspect of the present disclosure provides functional shoes and a functional unit for shoes, in which the functional unit is easy to couple and release and is robust.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, functional shoes include a sole, a coupling member including a coupling body, an auxiliary lever, and a fixing part, in which the coupling body is detachably coupled to the sole, the auxiliary lever is coupled to the coupling body so as to be rotatable toward a bottom surface of the sole, and the fixing part protrudes from the auxiliary lever toward the bottom surface of the sole and is detachably coupled to the sole, and at least one functional member integrally or detachably coupled to the coupling body to provide a predetermined function to the shoes. The fixing part is moved between a coupling position in which the fixing part is coupled to the sole and a separation position in which the fixing part is separated from the sole, by rotation of the auxiliary lever.

According to an aspect of the present disclosure, a functional unit for shoes, which is applied to soles of the shoes to provide a predetermined function to the shoes, includes a coupling member including a coupling body, an auxiliary lever, and a fixing part, in which the coupling body is detachably coupled to each sole, the auxiliary lever is coupled to the coupling body so as to be rotatable toward a bottom surface of the sole, and the fixing part protrudes from the auxiliary lever toward the bottom surface of the sole and is detachably coupled to the sole, and at least one functional member integrally or detachably coupled to the coupling body to provide the predetermined function to the shoes.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
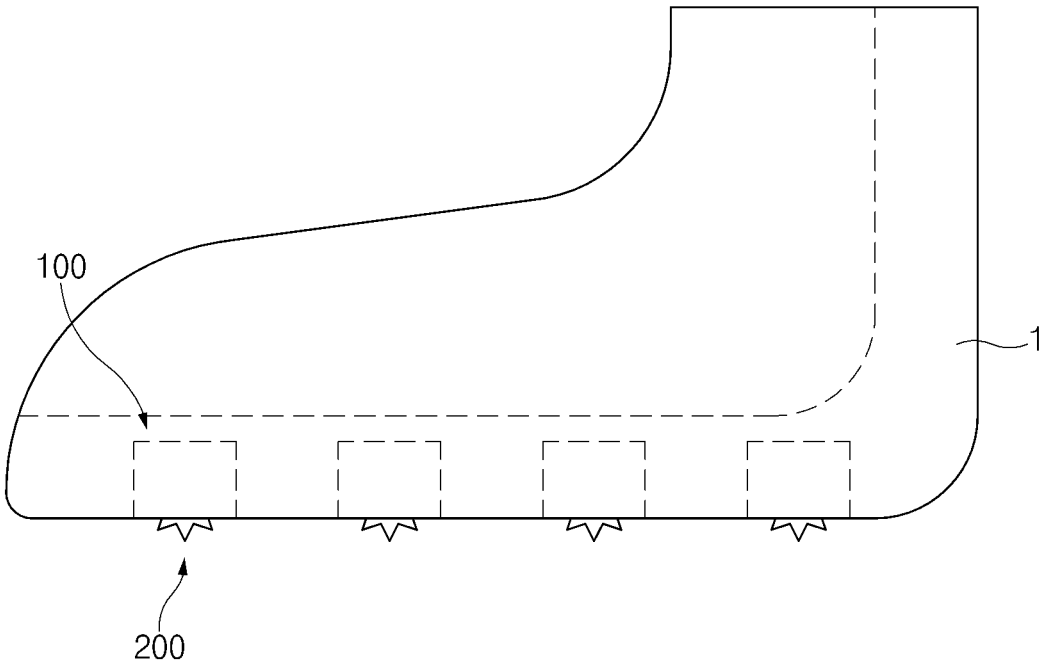
FIG. 1 is a side view of functional shoes according to an embodiment of the present disclosure.

Hereinafter, exemplary embodiments of the present disclosure will be described in detail with reference to the accompanying drawings. It should be understood that even if shown in different drawings, identical elements are provided with identical reference numerals in the drawings. Furthermore, in describing the embodiments of the present disclosure, detailed descriptions related to well-known functions or configurations will be omitted when they may make subject matters of the present disclosure unnecessarily obscure.

Configuration of Functional Shoes

Figure 2:
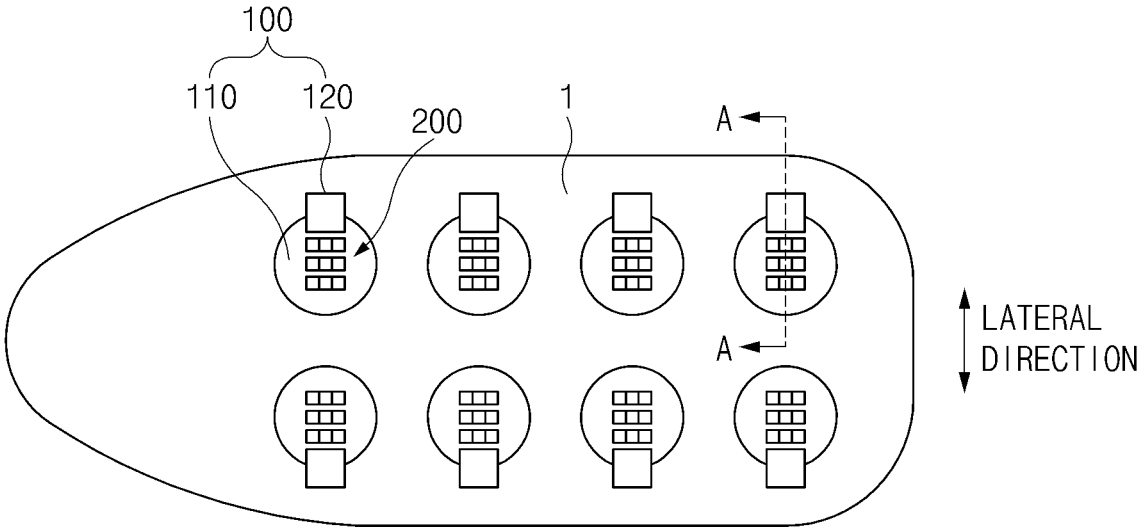
FIG. 2 is a bottom view of the functional shoes according to the embodiment of the present disclosure.

FIG. 1 is a side view of functional shoes according to an embodiment of the present disclosure. FIG. 2 is a bottom view of the functional shoes according to the embodiment of the present disclosure. Hereinafter, the functional shoes according to the embodiment of the present disclosure will be described with reference to FIGS. 1 and 2.

The functional shoes according to the embodiment of the present disclosure may include a sole 1 and one or more functional units applied to the sole 1 to provide a predetermined function to the shoes. Each of the functional units may include a coupling member 100 and a functional member 200. As illustrated in FIGS. 1 and 2, the coupling member 100 may be coupled to the sole 1, and the functional member 200 may be coupled to the coupling member 100 to provide the predetermined function to the shoes.

The coupling member 100 may be detachably coupled to the sole 1, and the functional member 200 may be integrally coupled to the coupling member 100. Therefore, a user may attach a functional unit with a desired function to the sole 1 and may detach the functional unit from the sole 1, thereby providing various functions to the shoes.

Figure 3:
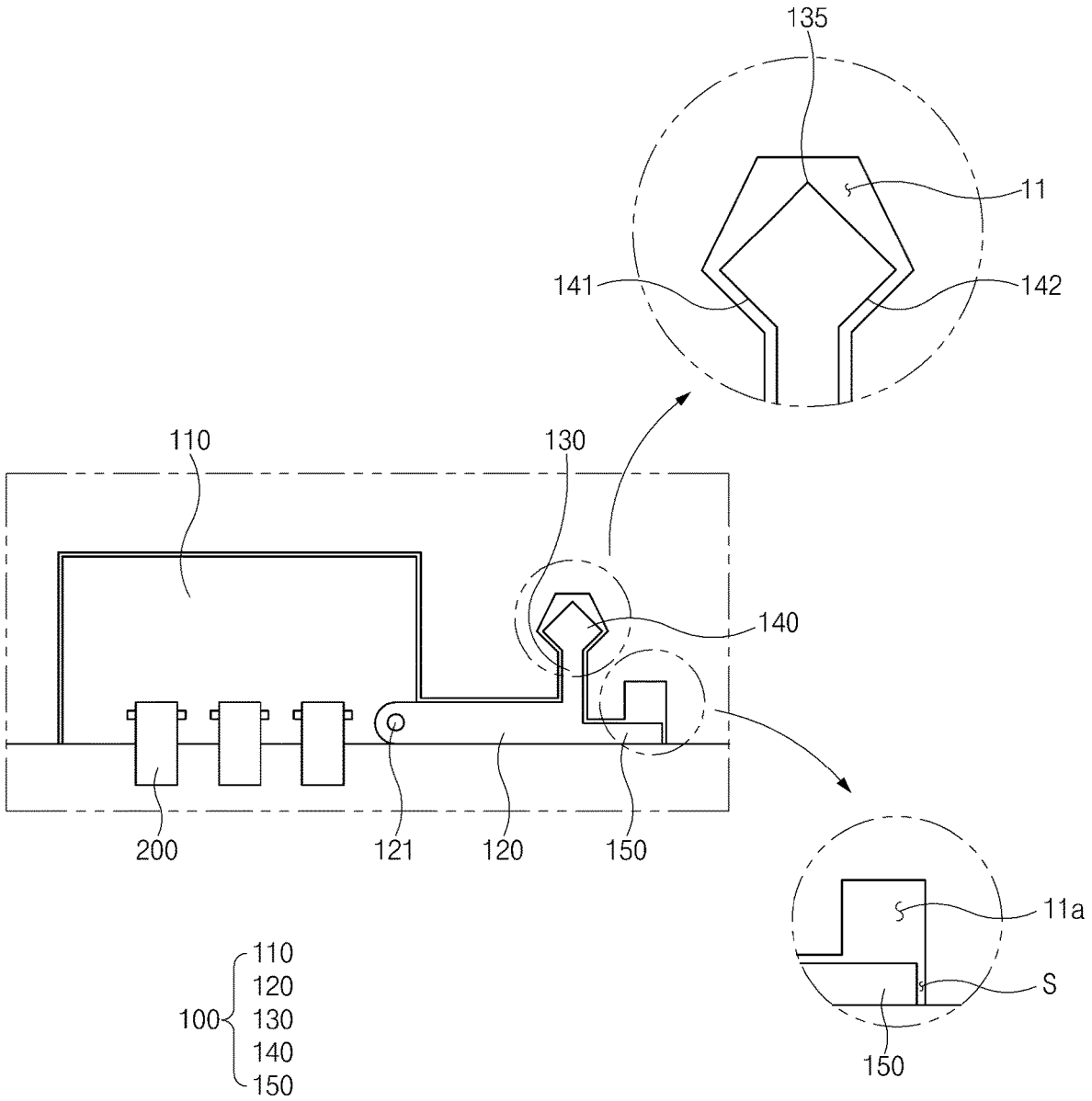
FIG. 3 is a partial cross-sectional view taken along line A-A of FIG. 2, where a fixing part is in a coupling position.
Figure 4:
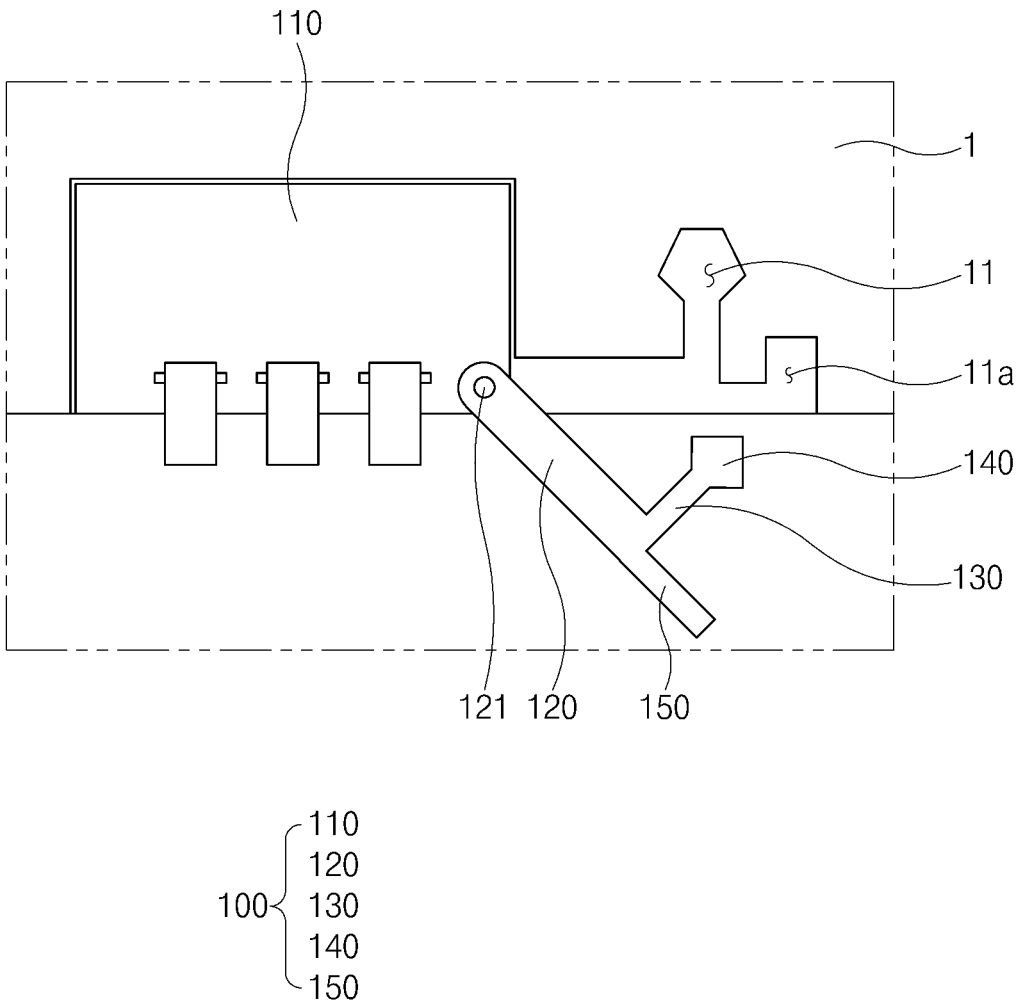
FIG. 4 is a partial cross-sectional view taken along line A-A of FIG. 2, where the fixing part is in a separation position.
Figure 5:
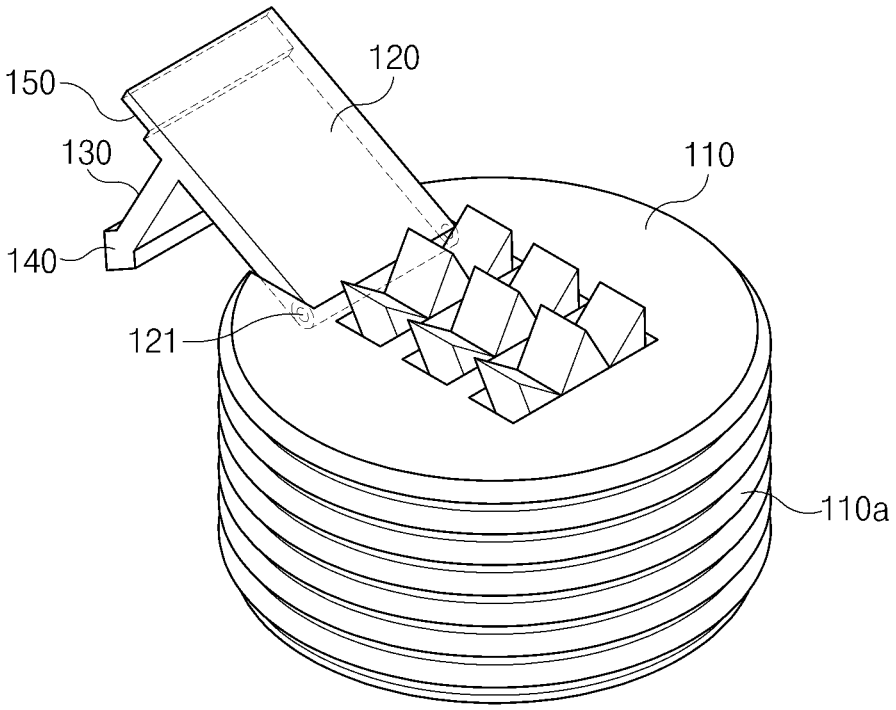
FIG. 5 is a perspective view of a coupling member according to an embodiment of the present disclosure.
Figure 6:
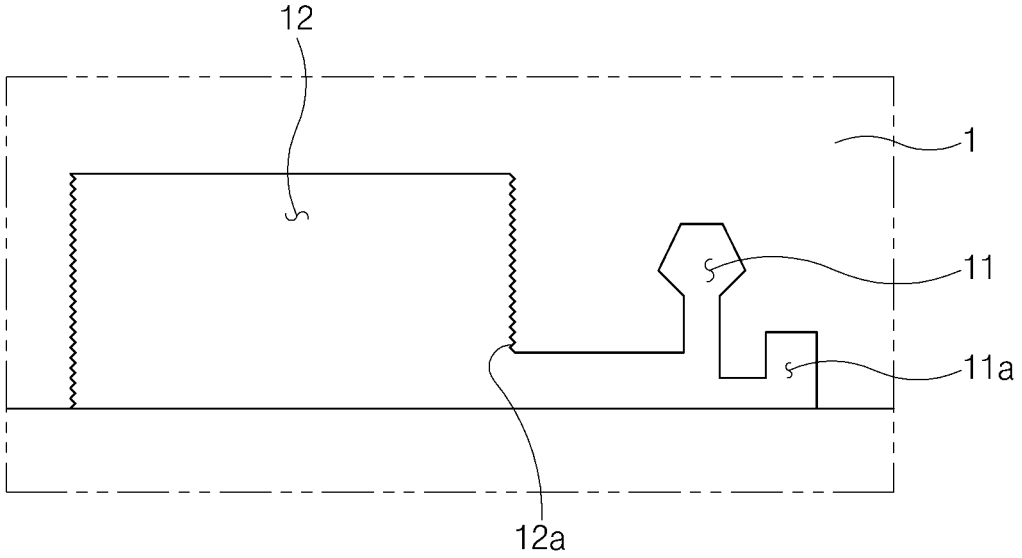
FIG. 6 is a partial cross-sectional view taken along line A-A of FIG. 2, where the coupling member is not coupled to a sole.

Hereinafter, the functional unit, that is, the coupling member 100 and the functional member 200, will be described in more detail with reference to FIGS. 3 to 8. FIG. 3 is a partial cross-sectional view taken along line A-A of FIG. 2, where a fixing part 130 to be described below is in a coupling position. FIG. 4 is a partial cross-sectional view taken along line A-A of FIG. 2, where the fixing part 130 is in a separation position. FIG. 5 is a perspective view of the coupling member 100 according to an embodiment of the present disclosure. FIG. 6 is a partial cross-sectional view taken along line A-A of FIG. 2, where the coupling member 100 is not coupled to the sole 1.

As illustrated in FIG. 3, the coupling member 100 may include a coupling body 110, an auxiliary lever 120, the fixing part 130, a stopping part 140, and a protruding part 150.

The coupling body 110 may refer to a body that is detachably coupled to the sole 1. While FIG. 5 illustrates that the coupling body 110 has a cylindrical shape, no special limitation applies to the shape of the coupling body 110. The functional member 200 described above and the auxiliary lever 120 to be described below may be coupled to the coupling body 110.

The auxiliary lever 120 may be coupled to the coupling body 110 so as to be rotatable toward the bottom surface of the sole 1. For example, the auxiliary lever 120 may be rotatably coupled to the coupling boy 110 through a rotary shaft 121 on a side of the auxiliary lever 120. Meanwhile, no special limitation applies to the shape of the auxiliary lever 120, but as illustrated in FIG. 3, the auxiliary lever 120 may be formed in a flat plate shape that extends from the rotary shaft 121 along the bottom surface of the sole 1, based on when the fixing part 130 is in the coupling position. FIG. 3 illustrates that the bottom surface of the sole 1 is flat. However, in the case where the sole 1 has a corrugated bottom surface according to types of shoes, the auxiliary lever 120 may also extend along the corrugated bottom surface of the sole 1.

The fixing part 130 protruding from the auxiliary lever 120 toward the bottom surface of the sole 1 may be detachably coupled to the sole 1 by moving between the coupling position and the separation position. The coupling position may refer to a position in which the fixing part 130 is coupled to the sole 1 as illustrated in FIG. 3, and the separation position may refer to a position in which the fixing part 130 is separated from the sole 1 as illustrated in FIG. 4.

The fixing part 130 may move between the coupling position and the separation position by rotation of the auxiliary lever 120 about the rotary shaft 121, and when the fixing part 130 is in the coupling position, the fixing part 130 may prevent the coupling body 110 from being separated from the sole 1 due to rotation, thereby more firmly fixing the coupling body 110 to the sole 1.

The stopping part 140 may refer to a part that protrudes from the fixing part 130 in at least one of a direction toward the coupling body 110 and an opposite direction away from the coupling body 110, based on when the fixing part 130 is in the coupling position. As illustrated in FIGS. 3 and 5, the stopping part 140 may protrude from the fixing part 130 in the at least one direction to have a larger thickness than the fixing part 130, thereby preventing the fixing part 130 from deviating from the coupling position.

The protruding part 150 may refer to a part that protrudes from the auxiliary lever 120 along the bottom surface of the sole 1, based on when the fixing part 130 is in the coupling position. When the fixing part 130 is in the coupling position, the user may apply force to the protruding part 150 in a direction away from the sole 1 to rotate the auxiliary lever 120, thereby easily moving the fixing part 130 from the coupling position to the separation position. No special limitation applies to the number of protruding parts 150 and the position where the protruding part 150 is formed.

As illustrated in FIG. 6, the sole 1 may include a first receiving section 11 that is concavely formed in a shape corresponding to the fixing part 130, the stopping part 140, and the protruding part 150, and a second receiving section 12 that is concavely formed in a shape corresponding to the shape of the coupling body 110 to receive the coupling body 110 therein.

When the fixing part 130 moves from the separation position to the coupling position so as to be received in the first receiving section 11, the first receiving section 11 may be elastically deformed by force exerted by the fixing part 130 and the stopping part 140 and may thereafter return to the original shape.

Referring to FIG. 3, the fixing part 130 may include a distal end portion 135 that has a gradually decreasing width toward an end thereof. The distal end portion 135 may allow the fixing part 130 to be easily inserted into the sole 1 when the fixing part 130 is moved from the separation position to the coupling position. The fixing part 130 and the stopping part 140 may be formed of an elastically deformable material, and the first receiving section 11 may be formed to be larger in size than the distal end portion 135, in a shape corresponding to the shape of the distal end portion 135. Accordingly, the first receiving section 11 may provide a marginal space for the fixing part 130 that elastically deforms while being inserted into the first receiving section 11 when coupled to the sole 1 and returns to the original shape in the first receiving section 11 when completely inserted into the first receiving section 11.

The stopping part 140 may include a first inclined surface 141 that extends from the fixing part 130 in a direction toward the coupling boy 110 and a second inclined surface 142 that extends from the fixing part 130 in a direction away from the coupling body 110. The first inclined surface 141 and the second inclined surface 142 may facilitate separation of the fixing part 130 when the fixing part 130 moves from the coupling position to the separation position.

Meanwhile, no special limitation applies to a method by which the coupling body 110 is coupled to the sole 1. For example, the coupling body 110 may be coupled to the sole 1 by screw-coupling. An external male thread 110*a* may be formed on one of the inner surface of the second receiving section 12 and the outer surface of the coupling body 110 (see FIG. 5), and an internal female thread 12*a* corresponding to the external male thread 110*a* may be formed on the other (see FIG. 6). The coupling member 100 may be screwed into the second receiving section 12 so that the coupling member 100 may be detachably coupled to the sole 1.

As illustrated in FIG. 2, the auxiliary lever 120 may be oriented in a direction corresponding to the lateral direction of the shoes when the fixing part 130 is in the coupling position. When the user wears the functional shoes, most of the force exerted on the functional shoes may act in the fore/aft directions of the shoes. The force exerted on the shoes may prevent the fixing part 130 from moving from the coupling position to the separation position when the auxiliary lever 120 is oriented in the direction corresponding to the lateral direction of the shoes. To achieve this, the external male thread 110*a* and the internal female thread 12*a* may be designed in advance such that the auxiliary lever 120 is oriented in the direction corresponding to the lateral direction of the shoes when the coupling body 110 is completely screwed into the second receiving section 12.

As described above, the functional member 200 may be integrally formed with the coupling body 110 to provide the predetermined function to the shoes. For example, as illustrated in FIG. 1, the functional member 200 may include an anti-slip member for preventing slipping of the shoes. However, no special limitation applies to the type of the functional member 200.

Figure 7:
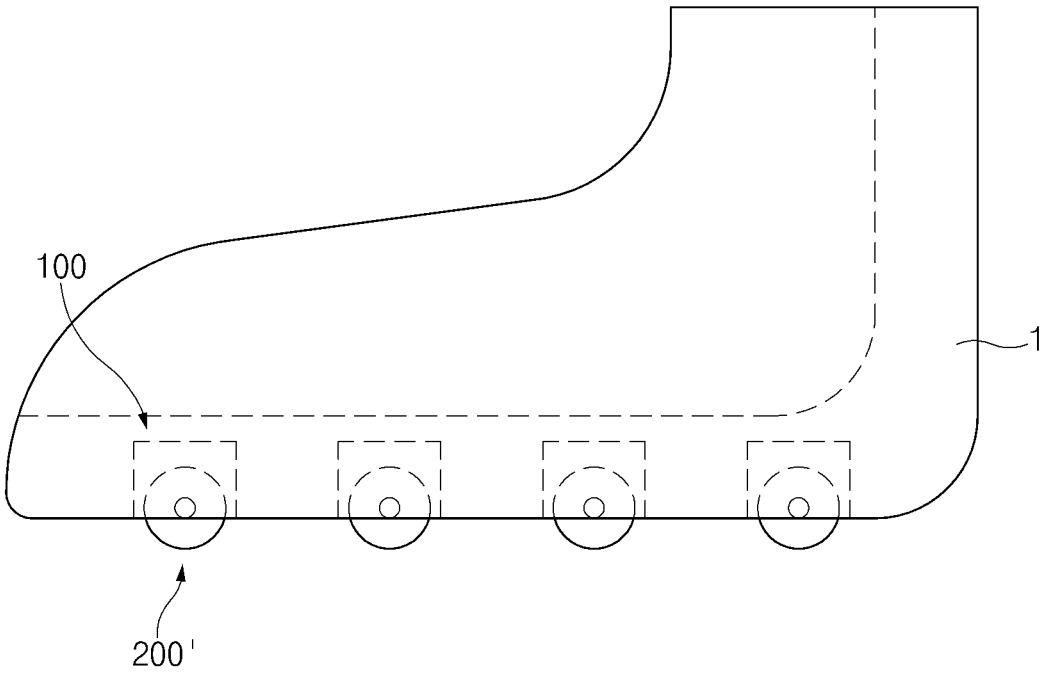
FIG. 7 is a side view of functional shoes according to another embodiment of the present disclosure.
Figure 8:
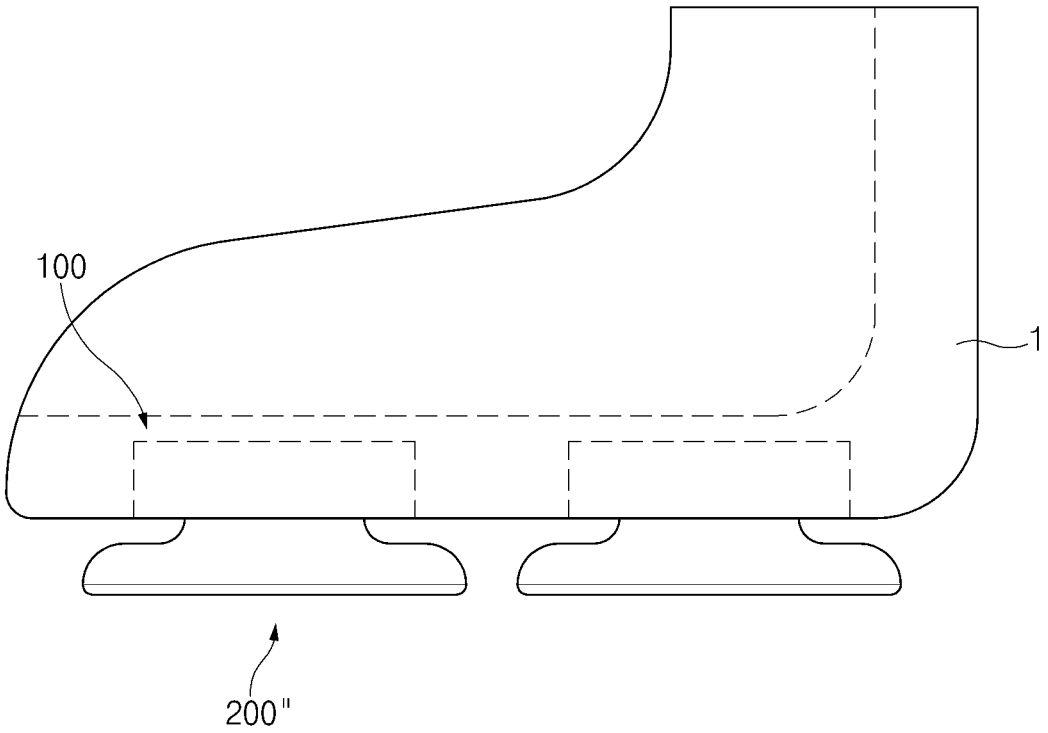
FIG. 8 is a side view of functional shoes according to another embodiment of the present disclosure.

FIGS. 7 and 8 are side views of functional shoes according to other embodiments of the present disclosure. As illustrated in FIG. 7, a functional member 200' may include a wheel for improving mobility of the shoes, and as illustrated in FIG. 8, a functional member 200" may include a skate blade that is used on ice.

Attachment Process and Detachment Process for the Functional Unit

Hereinafter, a process of attaching the functional unit to the sole 1 and a process of detaching the functional unit from the sole 1 will be described with reference to FIGS. 3 and 4.

When the coupling body 110 and the fixing part 130 are coupled to the sole 1 as illustrated in FIG. 3, the user needs to detach the attached functional unit from the sole 1 to apply a functional unit with a different functional member to the sole 1.

The user may press the protruding part 150, which is inserted into the first receiving section 11, in a direction away from the sole 1 to rotate the auxiliary lever 120, thereby moving the fixing part 130 from the coupling position to the separation position. A gap S may be formed between the first receiving section 11 and the protruding part 150, and the user may put his/her hand into the gap S to easily apply force to the protruding part 150. Furthermore, the first receiving section 11 may include a depression 11*a* that is concavely formed inward deeper than the protruding part 150, to enable the user to easily apply force to the protruding part 150.

When the fixing part 130 moves to the separation position as illustrated in FIG. 4, the user needs to separate the coupling body 110 from the second receiving section 12. The user may release the screw-coupling between the coupling body 110 and the second receiving section 12 with the auxiliary lever 120 serving as a handle. That is, the auxiliary lever 120, which is rotatably coupled to the coupling body 110, may serve as a handle at the time of separating and releasing the coupling body 110, as well as serving to move the fixing part 130. Accordingly, the user may very conveniently detach the functional unit attached to the sole 1.

In contrast, when the user wants to attach the functional unit including the functional member 200 to the sole 1, the user may locate the coupling body 110 under the second receiving section 12 and may thereafter screw the coupling body 110 into the second receiving section 12 by using the auxiliary lever 120 as a handle in the same way. When the auxiliary lever 120 is oriented in the direction corresponding to the lateral direction of the shoes, as illustrated in FIG. 2, after the coupling body 110 is sufficiently coupled to the second receiving section 12 by the screw-coupling, the user may rotate the auxiliary lever 120 toward the sole 1 to move the fixing part 130 from the separation position to the coupling position.

The user may very conveniently attach the functional unit to the sole 1 through the above-described process. The fixing part 130 and the stopping part 140 inserted into the first receiving section 11 may be firmly fixed in the sole 1 since the first receiving section 11 presses the fixing part 130 and the stopping part 140 while returning to the original shape after being elastically deformed.

Modified Example

Figure 9:
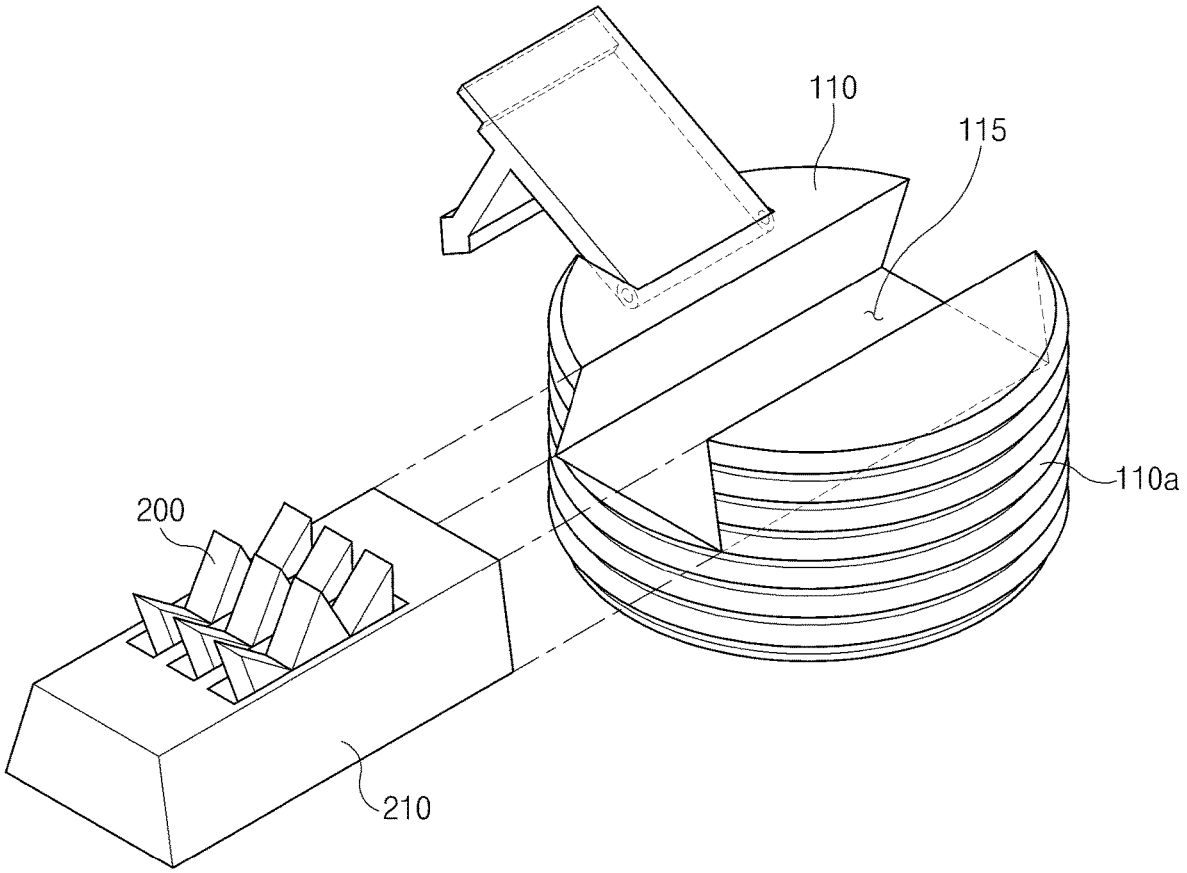
FIG. 9 is a perspective view of a functional unit according to a modified example of the present disclosure.

FIG. 9 is a perspective view of a functional unit according to a modified example of the present disclosure. The functional unit according to the modified example differs from the functional units according to the above-described embodiments in terms of a method for coupling the functional member 200. Other components are substantially the same as those in the above-described embodiments, and detailed descriptions thereof will be omitted.

As illustrated in FIG. 9, the functional member 200 of the functional unit according to the modified example may include a body 210 that is detachably coupled to the coupling body 110. The functional members according to the above-described embodiments differ from the functional member according to the modified example in that each of the functional members according to the above-described embodiments is integrally formed with the coupling body 110.

More specifically, the coupling body 110 of the functional unit according to the modified example may further include a coupling groove 115 that is concavely formed in a shape corresponding to the shape of the body 210 along the lateral direction of the shoes. The body 210 may be detachably coupled to the coupling body 110 by sliding into the coupling groove 115.

Although no special limitation applies to the shape of the body 210, the body 210 may have a shape with a top side wider than a bottom side when the shoes are viewed in the lateral direction, with the functional unit attached to the shoes. To prevent the body 210 from being separated from the coupling body 110, the top side of the body 210 has to be wider than the bottom side thereof.

The aforementioned functional members, such as the anti-slip member, the wheel, and the skate blade, may be coupled to the body 210. In the case of the functional unit according to the modified example, the user may selectively provide various functions to the shoes in an easy manner by replacing only the body 210 having the functional member coupled thereto, even though the user does not separate the coupling body 110 from the sole 1.

According to the present disclosure, various functions can be provided to the shoes by replacing only the functional unit.

In addition, according to the present disclosure, the functional unit can be firmly coupled to the sole and easily coupled to and released from the sole, through the coupling of the coupling body and the sole and the coupling of the fixing part and the sole.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. Functional shoes comprising:

a sole;

a coupling member including:

a coupling body detachably coupled to the sole;

an auxiliary lever coupled to the coupling body so as to be rotatable toward a bottom surface of the sole; and a fixing part protruding from the auxiliary lever toward the bottom surface of the sole and is detachably coupled to the sole, a stopping part protruding from the fixing part in at least one of a direction toward the coupling body and an opposite direction away from the coupling body, based on in a state when the fixing part is in a coupling position, and at least one protruding part protruding from the auxiliary lever along the bottom surface of the sole, based on when the fixing part is in the coupling position, and at least one functional member provided integrally with the coupling body or detachably coupled to the coupling body to provide a predetermined function to the shoes, wherein the fixing part moves between the coupling position in which the fixing part is coupled to the sole and a separation position in which the fixing part is separated from the sole, by a rotation of the auxiliary lever, wherein the sole includes a first receiving section that is concavely formed in a shape corresponding to shapes of the fixing part and the stopping part and including a depression that is concavely formed inward deeper than the protruding part and providing a marginal space for the fixing part to be elastically deformed, wherein the first receiving section is configured to be elastically deformed by force exerted by the fixing part and the stopping part and thereafter returns to an original shape when the fixing part moves from the separation position to the coupling position so as to be received in the first receiving section, wherein the fixing part is configured to move from the coupling position to the separation position as the auxiliary lever is rotated by force exerted on the protruding part in a direction away from the sole, and wherein a gap is formed between the first receiving section and the protruding part.

2. The functional shoes of claim 1, wherein the auxiliary lever is rotatably coupled to the coupling body by a rotary shaft on a side of the auxiliary lever and extends from the rotary shaft along the bottom surface of the sole, based on in a state when the fixing part is in the coupling position.

3. The functional shoes of claim 1, wherein the sole includes a second receiving section that is concavely formed in a shape corresponding to a shape of the coupling body to receive the coupling body in the second receiving section, and wherein an external male thread is formed on one of an inner surface of the second receiving section and an outer surface of the coupling body, an internal female thread is formed on the other, and the coupling body is screwed into the second receiving section and is coupled with the sole.

4. The functional shoes of claim 1, wherein the functional member includes an anti-slip member configured to prevent slipping of the shoes.

5. A functional unit for shoes, wherein the functional unit is applied to soles of the shoes to provide a predetermined function to the shoes, the functional unit comprising:

a coupling body detachably coupled to the sole;

an auxiliary lever coupled to the coupling body so as to be rotatable toward a bottom surface of the sole; and a fixing part protruding from the auxiliary lever toward the bottom surface of the sole and is detachably coupled to the sole, and at least one functional member provided integrally with the coupling body or detachably coupled to the coupling body to provide the predetermined function to the shoes, wherein the functional member includes a body that is coupled to the coupling body and that has a shape with a top side wider than a bottom side when viewed in a lateral direction of the shoes, wherein the coupling body includes a coupling groove that is concavely formed in a shape corresponding to the shape of the body along the lateral direction, and wherein the body slides into the coupling groove in the lateral direction so that the functional member is detachably coupled to the coupling body.

6. The functional unit of claim 5, wherein the sole includes a receiving section that is concavely formed in a shape corresponding to a shape of the coupling body to receive the coupling body in the receiving section, wherein an external male thread is formed on one of an inner surface of the receiving section and an outer surface of the coupling body, an internal female thread is formed on the other, and the coupling body is screwed into the receiving section and is coupled with the sole, and wherein the fixing part is moved to a coupling position and is coupled to the sole by rotation of the auxiliary lever to prevent the coupling body from being separated from the sole due to a rotation of the coupling body.

* * * * *